US010388211B2

(12) United States Patent
Deng

(10) Patent No.: US 10,388,211 B2
(45) Date of Patent: Aug. 20, 2019

(54) METHOD FOR STORING COMPENSATION TABLE OF OLED DISPLAY PANEL

(71) Applicant: Shenzhen China Star Optoelectronics Semiconductor Display Technology Co., Ltd., Shenzhen (CN)

(72) Inventor: Yufan Deng, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 8 days.

(21) Appl. No.: 15/570,380

(22) PCT Filed: Jul. 13, 2017

(86) PCT No.: PCT/CN2017/092688

§ 371 (c)(1),
(2) Date: Oct. 30, 2017

(87) PCT Pub. No.: WO2018/223486

PCT Pub. Date: Dec. 13, 2018

(65) Prior Publication Data

US 2018/0357951 A1 Dec. 13, 2018

(30) Foreign Application Priority Data

Jun. 9, 2017 (CN) ..... 2017 1 0433931

(51) Int. Cl.
*G09G 3/3208* (2016.01)

(52) U.S. Cl.
CPC ... *G09G 3/3208* (2013.01); *G09G 2300/0452* (2013.01); *G09G 2320/0285* (2013.01); *G09G 2350/00* (2013.01); *G09G 2360/16* (2013.01)

(58) Field of Classification Search
CPC ..... G09G 2320/0242; G09G 2360/16; G09G 3/3208; G09G 2320/0693
(Continued)

(56) References Cited

U.S. PATENT DOCUMENTS

2011/0080442 A1 4/2011 Ghosh et al.
2015/0187328 A1* 7/2015 Kim ..... G09G 5/02 345/690
(Continued)

FOREIGN PATENT DOCUMENTS

CN 105700847 A 6/2016
CN 105741764 A 7/2016
(Continued)

*Primary Examiner* — Jin Cheng Wang
(74) *Attorney, Agent, or Firm* — Leong C. Lei

(57) ABSTRACT

The invention provides a method for storing compensation table of OLED display panel, by obtaining the first and second sub-pixel compensation tables and defining the first sub-pixel compensation table as the benchmark table, and containing at least a calibration table based on the first and second sub-pixel compensation tables and a default compensation table translation formula, and guaranteeing the sum of the information entropy of the calibration tables being less than the information entropy of the second sub-pixel compensation table, and storing the compressed benchmark table and calibration table. As such, the present invention can eliminate the correlation among different sub-pixel compensation table before compression to achieve better compression efficiency and smaller size, the system storage space occupied by the compensation table is reduced and the time of transmitting and burning data on production line is shortened.

11 Claims, 1 Drawing Sheet

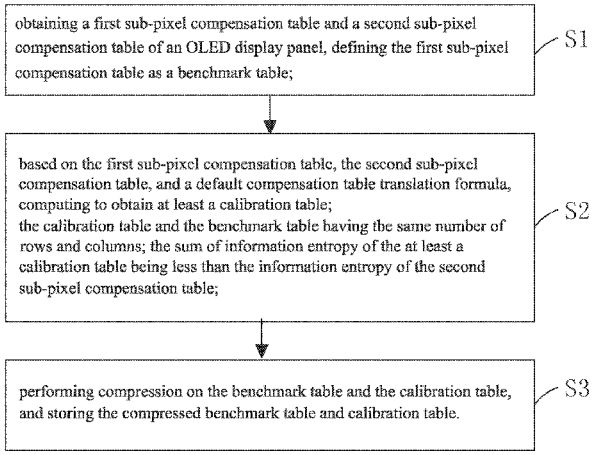

(58) Field of Classification Search
USPC ..... 345/690
See application file for complete search history.

(56) References Cited

U.S. PATENT DOCUMENTS

| | | | | |
|---|---|---|---|---|
| 2015/0193905 | A1* | 7/2015 | Lee | H04N 19/119 345/501 |
| 2017/0150147 | A1* | 5/2017 | Forsyth | H04N 19/124 |
| 2017/0236498 | A1* | 8/2017 | Zhou | H03M 7/30 345/555 |

FOREIGN PATENT DOCUMENTS

| | | | |
|---|---|---|---|
| CN | 106782300 | A | 5/2017 |
| KR | 20160041527 | A | 4/2016 |

* cited by examiner

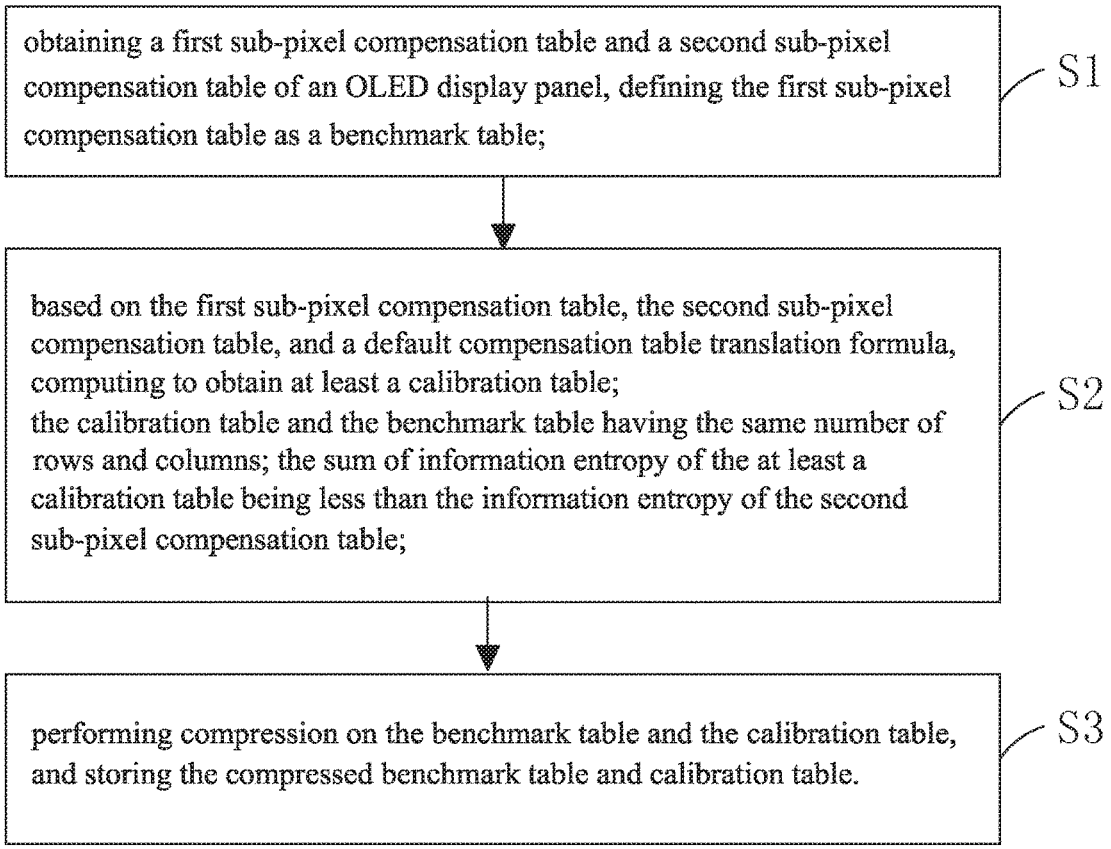
obtaining a first sub-pixel compensation table and a second sub-pixel compensation table of an OLED display panel, defining the first sub-pixel compensation table as a benchmark table;
S1
based on the first sub-pixel compensation table, the second sub-pixel compensation table, and a default compensation table translation formula, computing to obtain at least a calibration table;
the calibration table and the benchmark table having the same number of rows and columns; the sum of information entropy of the at least a calibration table being less than the information entropy of the second sub-pixel compensation table;
S2
performing compression on the benchmark table and the calibration table, and storing the compressed benchmark table and calibration table.
S3

METHOD FOR STORING COMPENSATION TABLE OF OLED DISPLAY PANEL

BACKGROUND OF THE INVENTION

1. Field of the Invention

The present invention relates to the field of display techniques, and in particular to a method for storing compensation table of OLED display panel.

2. The Related Arts

The organic light emitting diode (OLED) display provides the advantages of active light-emitting, need for backlight source, high contrast, thinness, wide viewing angle, quick response time, applicable to flexible panel, wide operation temperature range, simple structure and simple manufacturing process, and is regarded as the most promising display technology.

The OLED display device usually comprises: a substrate, an anode disposed on the substrate, an organic light-emitting layer disposed on the anode, an electron transport layer disposed on the organic light-emitting layer, and a cathode disposed on the electron transport layer. In operation, the holes from the anode and the electrons from the cathodes are emitted towards the organic light-emitting layer, and the electrons and holes are combined to generate excited electron-hole pairs, and the excited electron-hole pairs are transformed from the excited state to a base state to achieve light-emission.

Currently, in the manufacturing process of the flat display panel, the defect of mura (uneven luminance) often occurs due to the process imperfection, which leads to bright dots or dark dots and results in poor display quality for the panel. To eliminate the mura in OLED display, the known technique is to use a compensation table to store the compensation information of each pixel in the OLED display. In playback, the driver looks up in the compensation table and adjusts the signal by tuning up the signal of overly dark area in the panel and tuning down the signal of overly bright area in the panel to achieve uniform display effect. In the compensation table, each pixel corresponds to a set of compensation information, and each compensation information set comprises one or more compensation data. The physical meaning of the compensation data depends on the algorithm. In general, the data compensation data is an adjustment value of a specific grayscale or regional gamma value, and some algorithms even set the voltage to be adjusted to as compensation data.

In known technology, the size of compensation table equals to the number of pixels multiplied by the size of each compensation data set. For example, to compensate a 4 k2 k OLED display panel (the number of pixel columns is 3840, and the number of pixel rows is 2160), if the size of each compensation data set is 24 bits and the number of colors is three (red, green, and blue), the compensation table needs a storage of 2160*3840*24 bits*3≈597 Mb. The large amount of storage space of the system is occupied by the compensation table, and the process of transmitting and burning data takes much time, resulting in the degrading of operation speed and manufacturing efficiency of OLED display.

To reduce the size of compensation table and reduce the system storage space occupied by the compensation table, the known technology often compresses the data for each sub-pixel in the compensation table before storage. However, regardless of storing the compensation table directly or compressing the data for each sub-pixel in the compensation table separately before storage, the property is often not considered that a similarity and correlation exists among the mura of the sub-pixels of different color at the same coordination. Therefore, the compensation table comprises data redundancy and compression efficiency is low.

SUMMARY OF THE INVENTION

The object of the present invention is to provide a method for storing compensation table of OLED display device, able to reduce the system storage space occupied by the compensation table, shorten the time of transmitting and burning data on production line.

To achieve the above object, the present invention provides a method for storing compensation table of OLED display panel, comprising the steps of:

Step S1: obtaining a first sub-pixel compensation table (i.e., compensation table of a first sub-pixel) and a second sub-pixel compensation table (i.e., compensation table of a second sub-pixel) of an OLED display panel, defining the first sub-pixel compensation table as a benchmark table;

Step S2: based on the first sub-pixel compensation table, the second sub-pixel compensation table, and a default compensation table translation formula, computing to obtain at least a calibration table;

the calibration table and the benchmark table having the same number of rows and columns; the sum of information entropy of the at least a calibration table being less than the information entropy of the second sub-pixel compensation table;

Step S3: performing compression on the benchmark table and the calibration table, and storing the compressed benchmark table and calibration table.

According to a preferred embodiment of the present invention, the first sub-pixel and the second sub-pixel are of different colors.

According to a preferred embodiment of the present invention, the first sub-pixel is one of the red, green, or blue sub-pixels; and the second sub-pixel is another one of the red, green, or blue sub-pixels different from the first sub-pixel.

According to a preferred embodiment of the present invention, the compression method in step S3 is algorithm encoding compression, or run-length encoding compression.

Optionally, in step S2, two calibration tables are obtained by computing based on the first sub-pixel compensation table, the second sub-pixel compensation table, and a default compensation table translation formula; and the two calibration tables are a first calibration table and a second calibration table respectively.

According to a preferred embodiment of the present invention, the default translation formula in step S2 is:

$$C(i,j)=B(i,j)/A(i,j)\times 10;$$

$$D(i,j)=B(i,j)-C(i,j)\times A(i,j)/10;$$

wherein, C(i, j) is the value of the i-th row j-th column in the first calibration table; D(i, j) is the value of the i-th row j-th column in the second calibration table; B(i, j) is the value of the i-th row j-th column in the second sub-pixel compensation table; A(i, j) is the value of the i-th row j-th column in the first sub-pixel compensation table; i.j are positive integers.

Optionally, in step S2, one calibration table is obtained by computing based on the first sub-pixel compensation table, the second sub-pixel compensation table, and a default compensation table translation formula; and the one calibration table is a third calibration table.

According to a preferred embodiment of the present invention, the default translation formula in step S2 is:

$$E(i,j)=A(i,j)-B(i,j);$$

wherein, E(i, j) is the value of the i-th row j-th column in the third calibration table; B(i, j) is the value of the i-th row j-th column in the second sub-pixel compensation table; A(i, j) is the value of the i-th row j-th column in the first sub-pixel compensation table; i.j are positive integers.

According to a preferred embodiment of the present invention, the value of the first calibration table in step S2 has a precision to the units digit.

According to a preferred embodiment of the present invention, step S2 uses a rounding method to preserve the precision of the value of the first calibration table to the units digit.

The present invention also provides a method for storing compensation table of OLED display panel, comprising the steps of:

Step S1: obtaining a first sub-pixel compensation table (i.e., compensation table of a first sub-pixel) and a second sub-pixel compensation table (i.e., compensation table of a second sub-pixel) of an OLED display panel, defining the first sub-pixel compensation table as a benchmark table;

Step S2: based on the first sub-pixel compensation table, the second sub-pixel compensation table, and a default compensation table translation formula, computing to obtain at least a calibration table;

the calibration table and the benchmark table having the same number of rows and columns; the sum of information entropy of the at least a calibration table being less than the information entropy of the second sub-pixel compensation table;

Step S3: performing compression on the benchmark table and the calibration table, and storing the compressed benchmark table and calibration table;

wherein the first sub-pixel and the second sub-pixel are of different colors;

wherein the compression method in step S3 is algorithm encoding compression, or run-length encoding compression;

wherein, in step S2, two calibration tables are obtained by computing based on the first sub-pixel compensation table, the second sub-pixel compensation table, and a default compensation table translation formula; and the two calibration tables are a first calibration table and a second calibration table respectively;

wherein, the default translation formula in step S2 is: C(i, j)=B(i, j)/A(i, j)×10; D(i, j)=B(i, j)−C(i, j)×A(i, j)/10; wherein, C(i, j) is the value of the i-th row j-th column in the first calibration table; D(i, j) is the value of the i-th row j-th column in the second calibration table; B(i, j) is the value of the i-th row j-th column in the second sub-pixel compensation table; A(i, j) is the value of the i-th row j-th column in the first sub-pixel compensation table; i.j are positive integers.

Compared to the known techniques, the present invention provides the following advantages. The present invention provides a method for storing compensation table of OLED display panel, by obtaining the first and second sub-pixel compensation tables and defining the first sub-pixel compensation table as the benchmark table, and containing at least a calibration table based on the first and second sub-pixel compensation tables and a default compensation table translation formula, and guaranteeing the sum of the information entropy of the calibration tables being less than the information entropy of the second sub-pixel compensation table, and storing the compressed benchmark table and calibration table. As such, the present invention can eliminate the correlation among different sub-pixel compensation table before compression to achieve better compression efficiency and smaller size, the system storage space occupied by the compensation table is reduced and the time of transmitting and burning data on production line is shortened.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings:

FIG. 1 is a schematic view showing a flowchart of the method for storing compensation table of OLED display panel according to the present invention.

DETAILED DESCRIPTION OF THE PREFERRED EMBODIMENTS

To further explain the technique means and effect of the present invention, the following uses preferred embodiments and drawings for detailed description.

Referring to FIG. 1, the present invention provides a method for storing compensation table of OLED display panel, comprising:

Step S1: obtaining a first sub-pixel compensation table (i.e., compensation table of a first sub-pixel) and a second sub-pixel compensation table (i.e., compensation table of a second sub-pixel) of an OLED display panel, defining the first sub-pixel compensation table as a benchmark table.

Specifically, the first sub-pixel and the second sub-pixel are sub-pixels of different colors in the OLED display panel. For example, when the OLED display panel comprises red, green, and blue sub-pixels, the first sub-pixel may be one of the red, green, or blue sub-pixels; and the second sub-pixel is another one of the red, green, or blue sub-pixels different from the first sub-pixel.

Step S2: based on the first sub-pixel compensation table, the second sub-pixel compensation table, and a default compensation table translation formula, computing to obtain at least a calibration table;

the calibration table and the benchmark table having the same number of rows and columns; the sum of information entropy of the at least a calibration table being less than the information entropy of the second sub-pixel compensation table.

Optionally, in the first embodiment of the present invention, in step S2, two calibration tables are obtained by computing based on the first sub-pixel compensation table, the second sub-pixel compensation table, and a default compensation table translation formula; and the two calibration tables are a first calibration table and a second calibration table respectively.

Furthermore, the default translation formula in step S2 is:

$$C(i,j)=B(i,j)/A(i,j)\times 10;$$

$$D(i,j)=B(i,j)-C(i,j)\times A(i,j)/10;$$

wherein, C(i, j) is the value of the i-th row j-th column in the first calibration table; D(i, j) is the value of the i-th row j-th column in the second calibration table; B(i, j) is the value of the i-th row j-th column in the second sub-pixel compensation table; A(i, j) is the value of the i-th row j-th column in the first sub-pixel compensation table; i.j are positive integers.

Furthermore, in the first embodiment of the present invention, the value of the first calibration table in step S2 has a precision to the units digit. Specifically, step S2 uses a rounding method to preserve the precision of the value of the first calibration table to the units digit. Optionally, in the second embodiment of the present invention, in step S2, one calibration table is obtained by computing based on the first sub-pixel compensation table, the second sub-pixel compensation table, and a default compensation table translation formula; and the one calibration table is a third calibration table.

Furthermore, the default translation formula in step S2 is:

$$E(i,j)=A(i,j)-B(i,j);$$

wherein, E(i, j) is the value of the i-th row j-th column in the third calibration table; B(i, j) is the value of the i-th row j-th column in the second sub-pixel compensation table; A(i, j) is the value of the i-th row j-th column in the first sub-pixel compensation table; i.j are positive integers.

Apparently, the default compensation table translation formula is not restricted to the first and second embodiments. Other appropriate formula can also be used in the present invention as long as the sum of the information entropy of the at least a calibration table is less than the information entropy of the second sub-pixel compensation table.

Step S3: performing compression on the benchmark table and the calibration table, and storing the compressed benchmark table and calibration table.

Preferably, the compression method in step S3 is algorithm encoding compression, or run-length encoding compression. Apparently, the compression method is not limited to the above exemplars; other appropriate compression methods can also be used.

For example, the first step is to obtain a first sub-pixel compensation table and a second sub-pixel compensation table, as shown in Table 1 and Table 2, respectively:

TABLE 1

| first sub-pixel compensation table | | |
|---|---|---|
| 175 | 173 | 172 |
| 169 | 168 | 166 |
| 170 | 170 | 184 |

TABLE 2

| second sub-pixel compensation table | | |
|---|---|---|
| 171 | 174 | 170 |
| 166 | 169 | 169 |
| 167 | 160 | 169 |

Then, defining the first sub-pixel compensation table as the benchmark table. Based on the compensation table translation formula provided in the first embodiment, the first calibration table and the second calibration table are computed, as shown in Table 3 and Table 4, respectively.

TABLE 3

| first calibration table | | |
|---|---|---|
| 10 | 10 | 10 |
| 10 | 10 | 10 |
| 10 | 9 | 9 |

TABLE 2

| second calibration table | | |
|---|---|---|
| −4 | 1 | −2 |
| −3 | 1 | 3 |
| −3 | 7 | 3 |

Finally, the benchmark table, first calibration table and second calibration table are compressed and stored.

According to calculation, the information entropy of second sub-pixel compensation table shown in Table 2 is 6.3, and the estimated compression ratio is 6.3÷8×100%≈79%; the information entropy of first calibration table shown in Table 3 is 0.8, and the estimated compression ratio is 0.8÷8×100%≈1%; the information entropy of second calibration table shown in Table 4 is 3.5, and the estimated compression ratio is 3.53÷8×100%≈44%; and the sum of the estimated compression ratio of the first and second calibration tables is less than the estimated compression ratio of the second sub-pixel compensation table. As such, compared to storing the second sub-pixel compensation table directly in the known technique, the present invention uses calibration tables to replace the second sub-pixel compensation table to obtain better compression ratio and smaller data size. Therefore, the system storage space occupied by the compensation table is reduced, and the time for transmitting and burning data in production line is shortened.

In general, an OLED display device usually comprises: red sub-pixels, green sub-pixels, and blue sub-pixels, with each color of sub-pixels corresponding to a compensation table. By using the present invention, one of the compensation tables can be defined as the benchmark, and the compensation table translation formula can be used to obtain at least a calibration table corresponding to the other two compensation tables. Finally, the benchmark table and the at least two calibration tables can be compressed and stored to completely preserve the three compensation tables corresponding to the three colors of sub-pixels in the OLED display device. The original compensation tables can be restored by using inverse calculation of the compensation table translation formula.

In summary, the present invention provides a method for storing compensation table of OLED display panel, by obtaining the first and second sub-pixel compensation tables and defining the first sub-pixel compensation table as the benchmark table, and containing at least a calibration table based on the first and second sub-pixel compensation tables and a default compensation table translation formula, and guaranteeing the sum of the information entropy of the calibration tables being less than the information entropy of the second sub-pixel compensation table, and storing the compressed benchmark table and calibration table. As such, the present invention can eliminate the correlation among different sub-pixel compensation table before compression to achieve better compression efficiency and smaller size, the system storage space occupied by the compensation table is reduced and the time of transmitting and burning data on production line is shortened.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A method for storing compensation table of organic light-emitting diode (OLED) display panel, comprising the steps of:

Step S1: obtaining a first sub-pixel compensation table, which is a compensation table of a first sub-pixel of an OLED display panel, and a second sub-pixel compensation table, which is a compensation table of a second sub-pixel of the OLED display panel, defining the first sub-pixel compensation table as a benchmark table;

Step S2: based on the first sub-pixel compensation table, the second sub-pixel compensation table, and a default compensation table translation formula, obtaining at least a calibration table through computation applied on the first sub-pixel compensation table and the second sub-pixel compensation table with the default compensation table translation formula;

the calibration table and the benchmark table having the same number of rows and columns; the sum of information entropy of the at least a calibration table being less than the information entropy of the second sub-pixel compensation table; and Step S3: performing compression on the benchmark table and the at least a calibration table, and storing the compressed benchmark table and calibration table;

wherein the first sub-pixel is of a first color and the second sub-pixel is of a second color that is different from the first color; and wherein the computation applied on the first sub-pixel compensation table and the second sub-pixel compensation table with the default compensation table translation formula to obtain the at least a calibration table includes a rounding operation applied to a ratio between a value of the second sub-pixel of the second color and a value of the first sub-pixel of the first color.

2. The method for storing compensation table of OLED display panel as claimed in claim 1, wherein the first sub-pixel is one of red, green, and blue sub-pixels; and the second sub-pixel is one of the red, green, and blue sub-pixels that is different from the first sub-pixel.

3. The method for storing compensation table of OLED display panel as claimed in claim 1, wherein the compression method in step S3 is algorithm encoding compression, or run-length encoding compression.

4. The method for storing compensation table of OLED display panel as claimed in claim 1, wherein in step S2, the at least a calibration table comprises two calibration tables, which are obtained through the computation applied on the first sub-pixel compensation table and the second sub-pixel compensation table with the default compensation table translation formula; and the two calibration tables are a first calibration table and a second calibration table respectively.

5. The method for storing compensation table of OLED display panel as claimed in claim 4, wherein the default compensation table translation formula in step S2 is:

$$C(i,j)=\text{Rounding}[B(i,j)/A(i,j)\times 10];$$

$$D(i,j)=B(i,j)-C(i,j)\times A(i,j)/10;$$

wherein C(i, j) is a value of an element in i-th row and j-th column of the first calibration table; D(i, j) is a value of an element in i-th row and j-th column of the second calibration table; B(i, j) is a value of an element in i-th row and j-th column of the second sub-pixel compensation table; A(i, j) is a value of an element in i-th row and j-th column of the first sub-pixel compensation table; and i and j are positive integers; and wherein Rounding indicates an operation of rounding to integer.

6. The method for storing compensation table of OLED display panel as claimed in claim 5, wherein the value of the first calibration table in step S2 has a precision to the units digit.

7. The method for storing compensation table of OLED display panel as claimed in claim 6, wherein step S2 uses a rounding method to preserve the precision of the value of the first calibration table to the units digit.

8. A method for storing compensation table of organic light-emitting diode (OLED) display panel, comprising the steps of:

Step S1: obtaining a first sub-pixel compensation table, which is a compensation table of a first sub-pixel of an OLED display panel, and a second sub-pixel compensation table, which is a compensation table of a second sub-pixel of the OLED display panel, defining the first sub-pixel compensation table as a benchmark table;

Step S2: based on the first sub-pixel compensation table, the second sub-pixel compensation table, and a default compensation table translation formula, obtaining at least a calibration table through computation applied on the first sub-pixel compensation table and the second sub-pixel compensation table with the default compensation table translation formula;

the calibration table and the benchmark table having the same number of rows and columns; the sum of information entropy of the at least a calibration table being less than the information entropy of the second sub-pixel compensation table; and Step S3: performing compression on the benchmark table and the at least a calibration table, and storing the compressed benchmark table and calibration table;

wherein the first sub-pixel is of a first color and the second sub-pixel is of a second color that is different from the first color;

wherein the computation applied on the first sub-pixel compensation table and the second sub-pixel compensation table with the default compensation table translation formula to obtain the at least a calibration table includes a rounding operation applied to a ratio between a value of the second sub-pixel of the second color and a value of the first sub-pixel of the first color;

wherein the compression method in step S3 is algorithm encoding compression, or run-length encoding compression;

wherein in step S2, the at least a calibration table comprises two calibration tables, which are obtained through the computation applied on the first sub-pixel compensation table and the second sub-pixel compensation table with the default compensation table translation formula; and the two calibration tables are a first calibration table and a second calibration table respectively;

wherein the default compensation table translation formula in step S2 is:

$$C(i,j)=\text{Rounding}[B(i,j)/A(i,j)\times 10];$$

$$D(i,j)=B(i,j)-C(i,j)\times A(i,j)/10;$$

wherein C(i, j) is a value of an element in i-th row and j-th column of the first calibration table; D(i, j) is a value of an element in i-th row and j-th column of the second calibration table; B(i, j) is a value of an element in i-th row and j-th column of the second sub-pixel compensation table; A(i, j) is a value of an element in i-th row and j-th column of the first sub-pixel compensation table; and i and j are positive integers; and wherein Rounding indicates an operation of rounding to integer.

9. The method for storing compensation table of OLED display panel as claimed in claim 8, wherein the first sub-pixel is one of red, green, and blue sub-pixels; and the second sub-pixel is one of the red, green, and blue sub-pixels that is different from the first sub-pixel.

10. The 1 method for storing compensation table of OLED display panel as claimed in claim 8, wherein the value of the first calibration table in step S2 has a precision to the units digit.

11. The method for storing compensation table of OLED display panel as claimed in claim 10, wherein step S2 uses a rounding method to preserve the precision of the value of the first calibration table to the units digit.

* * * * *